US010233790B2

(12) United States Patent
Yamaguchi et al.

(10) Patent No.: US 10,233,790 B2
(45) Date of Patent: Mar. 19, 2019

(54) VARIABLE VALVE MECHANISM OF INTERNAL COMBUSTION ENGINE

(71) Applicant: OTICS CORPORATION, Nishio-shi (JP)

(72) Inventors: Koki Yamaguchi, Nishio (JP); Naoki Hiramatsu, Nishio (JP); Masatoshi Sugiura, Nishio (JP)

(73) Assignee: OTICS CORPORATION, Nishio-Shi, Aichi-Ken (JP)

( * ) Notice: Subject to any disclaimer, the term of this patent is extended or adjusted under 35 U.S.C. 154(b) by 139 days.

(21) Appl. No.: 15/365,661

(22) Filed: Nov. 30, 2016

(65) Prior Publication Data

US 2017/0218795 A1 Aug. 3, 2017

(30) Foreign Application Priority Data

Jan. 29, 2016 (JP) ..... 2016-015158

(51) Int. Cl.

| | |
|---|---|
| ***F01L 1/34*** | (2006.01) |
| ***F01L 1/22*** | (2006.01) |
| ***F01L 1/18*** | (2006.01) |
| ***F01L 13/00*** | (2006.01) |
| *F01L 1/08* | (2006.01) |

(52) U.S. Cl.

CPC *F01L 1/22* (2013.01); *F01L 1/18* (2013.01); *F01L 13/0063* (2013.01); *F01L 1/08* (2013.01); *F01L 1/185* (2013.01); *F01L 2013/0068* (2013.01); *F01L 2105/00* (2013.01); *F01L 2820/02* (2013.01)

(58) Field of Classification Search

CPC ..... F01L 1/22; F01L 1/18; F01L 1/08; F01L 1/185; F01L 13/0063; F01L 2013/0068; F01L 2105/00; F01L 2820/02

USPC ..... 123/90.16

See application file for complete search history.

(56) References Cited

FOREIGN PATENT DOCUMENTS

| | | | |
|---|---|---|---|
| EP | 2 025 905 | A1 | 2/2009 |
| FR | 2 569 226 | A1 | 2/1986 |
| JP | 2006-046111 | A | 2/2006 |
| JP | 3799944 | B2 | 7/2006 |
| JP | 2007-077940 | A | 3/2007 |

(Continued)

OTHER PUBLICATIONS

Extended European Search Report dated Sep. 27, 2017 in European Application No. 16197491.0.

*Primary Examiner* — Zelalem Eshete

(74) *Attorney, Agent, or Firm* — McGinn IP Law Group, PLLC.

(57) ABSTRACT

A variable valve mechanism of an internal combustion engine includes a cam, a transmission mechanism, a first variable device that controls the transmission mechanism to continuously change at least a maximum lift amount of a lift curve indicating a lift amount of a valve that corresponds to a rotation angle of the internal combustion engine, and a second variable device that controls the transmission mechanism to continuously change at least an operation angle of the lift curve. When the lift curve lies in any condition within a predetermined range that covers all or part of a variable range of the lift curve, an absolute value of a ratio of a maximum lift amount variation to an operation angle variation for a slight change from the condition caused by the first variable device is larger than that for a slight change from the condition caused by the second variable device.

16 Claims, 9 Drawing Sheets

(56) References Cited

FOREIGN PATENT DOCUMENTS

| | | | |
|---|---|---|---|
| JP | 4143012 | B2 | 9/2008 |
| JP | 4771874 | B2 | 9/2011 |

CHANGE IN LIFT CURVE CAUSED BY FIRST VARIABLE DEVICE

CHANGE IN LIFT CURVE CAUSED BY SECOND VARIABLE DEVICE

CHANGE IN LIFT CURVE CAUSED BY FIRST VARIABLE DEVICE

CHANGE IN LIFT CURVE CAUSED BY SECOND VARIABLE DEVICE

VARIABLE VALVE MECHANISM OF INTERNAL COMBUSTION ENGINE

TECHNICAL FIELD

The present invention relates to a variable valve mechanism that drives valves of an internal combustion engine and changes a drive state of the valves in accordance with an operating condition of the internal combustion engine.

BACKGROUND ART

As shown in FIGS. 9A and 9B, a known variable valve mechanism changes a maximum lift amount L and an operation angle θ simultaneously and continuously, as described for example in Patent Documents 1 to 4.

CITATION LIST

Patent Document

[Patent Document 1] Japanese Patent No. 3799944
[Patent Document 2] Japanese Patent No. 4143012
[Patent Document 3] Japanese Patent No. 4771874
[Patent Document 4] Japanese Patent Application Publication No. 2007-077940

SUMMARY OF INVENTION

Technical Problem

The variable valve mechanism, described in Patent Documents 1 to 4, can merely change a lift curve C such that a ratio dL/dθ of a maximum lift amount variation dL to an operation angle variation dθ is substantially constant, and thus the lift curve C is changed with its substantially similar shape, as shown in FIG. 9A or 9B. Accordingly, the maximum lift amount L is increased with the increase in the operation angle θ, and is decreased with the decrease in the operation angle θ. Thus, the maximum lift amount L cannot be increased with the decrease in the operation angle θ, and cannot be decreased with the increase in the operation angle θ.

However, such control will be required to further improve performance of the internal combustion engine. An object of the present invention is thus to provide a variable valve mechanism that can freely change the maximum lift amount and the operation angle.

Solution to Problem

To achieve the above-described object, a variable valve mechanism of the present invention is configured as below. That is, the variable valve mechanism includes: a cam that rotates with rotation of the internal combustion engine; a transmission mechanism that transmits a profile of the cam to a valve to drive the valve; a first variable device that controls the transmission mechanism to continuously change at least a maximum lift amount of a lift curve indicating a lift amount of the valve that corresponds to a rotation angle of the internal combustion engine; and a second variable device that controls the transmission mechanism to continuously change at least an operation angle of the lift curve. Furthermore, the variable valve mechanism satisfies any one of the following requirements 1) to 3).

1) When the lift curve lies in any condition within a predetermined range that covers all or part of a variable range of the lift curve, an absolute value of a ratio (dL/dθ) of a maximum lift amount variation to an operation angle variation for a slight change from the condition caused by the first variable device is larger than that for a slight change from the condition caused by the second variable device.

More preferably, the absolute value of the ratio (dL/dθ) for the slight change caused by the first variable device is equal to or larger than ten times that for the slight change caused by the second variable device. Most preferably, the absolute value of the ratio (dL/dθ) for the slight change caused by the first variable device is substantially ∞ mm/degree, and the absolute value of the ratio (dL/dθ) for the slight change caused by the second variable device is substantially 0 mm/degree.

The predetermined range is not limited to a particular range, and the maximum lift amount and the operation angle may be in any numerical range. Preferably, the predetermined range covers all or most part of the variable range. It is also preferable that the predetermined range include a point at which the product of the maximum lift amount and the operation angle is maximum. Most preferably, in the case where the maximum lift amount and the operation angle both cannot be changed into zero, the predetermined range covers all the variable range; in the case where the maximum lift amount or the operation angle can be changed into zero, the predetermined range covers all the variable range except for a point of zero and a vicinity of the point.

2) The variable width (ΔL) of the maximum lift amount for the first variable device is larger than that for the second variable device, and the variable width (Δθ) of the operation angle for the first variable device is smaller than that for the second variable device.

More preferably, the variable width of the maximum lift amount for the first variable device is equal to or larger than ten times that for the second variable device, and the variable width of the operation angle for the first variable device is equal to or smaller than one-tenth that for the second variable device. Most preferably, the variable width of the operation angle for the first variable device is substantially zero, and the variable width of the maximum lift amount for the second variable device is substantially zero.

3) An absolute value of a ratio (ΔL/Δθ) of the variable width of the maximum lift amount to the variable width of the operation angle for the first variable device is larger than that for the second variable device.

More preferably, the absolute value of the ratio (ΔL/Δθ) for the first variable device is equal to or larger than ten times that for the second variable device. Most preferably, the absolute value of the ratio (ΔL/Δθ) for the first variable device is substantially ∞ mm/degree, and the absolute value of the ratio (ΔL/Δθ) for the second variable device is substantially 0 mm/degree.

Advantageous Effects of Invention

According to the present invention, the maximum lift amount and the operation angle can be freely changed by changing the lift curve by using the first variable device and the second variable device. Accordingly, the maximum lift amount can be increased with the decrease in the operation angle, and can be decreased with the increase in the operation angle.

DESCRIPTION OF EMBODIMENTS

Figure 1:
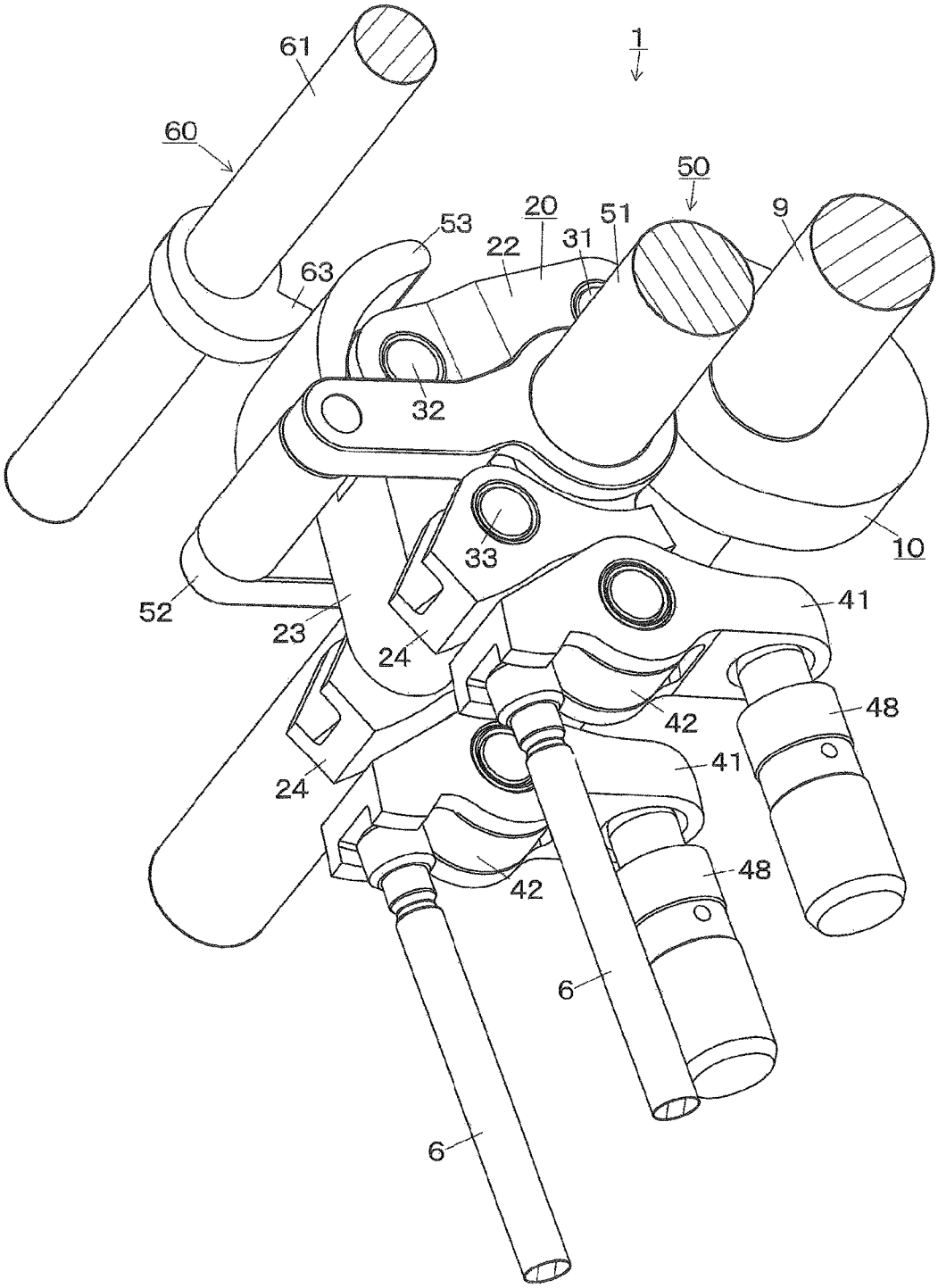
FIG. 1 is a perspective view showing a variable valve mechanism of Embodiment 1.

The specific configuration of the variable valve mechanism of the present invention is not limited to a particular configuration. For example, the configuration of the variable valve mechanism may include, between any one of variable valve mechanisms of Patent Documents 1 to 4 (JP 3799944, JP 4143012, JP 4771874, and JP 2007-077940 A) and a valve, a part provided between a cam of another one of the above variable valve mechanisms and a valve. However, the variable valve mechanism of the present invention is preferably configured as below so as to have a shorter valve system (transmission mechanism).

The transmission mechanism has four links coupled to one another via joints. A first variable device is configured to shift at least a reciprocating motion direction of a predetermined joint when the valve is driven. A second variable device is configured to shift at least a position of the predetermined joint during a base-circle time in which a base circle of a cam acts.

A specific aspect of the first variable device is not limited to a particular aspect, but an example thereof is as follows. That is, the first variable device includes a first control shaft provided so as to be rotatably controlled, a rotary lever that extends from the first control shaft in a radial direction of the first control shaft and rotates with the first control shaft, and a guide member rotatably attached to the leading end of the rotary lever so as to guide the reciprocating motion direction of the predetermined joint. Preferably, two of the four links are swingably supported on the first control shaft. This is because the first control shaft can also serve as a support shaft of the two links and thus the number of parts of the variable valve mechanism can be reduced to allow making the variable valve mechanism compact.

A specific aspect of the second variable device is not limited to a particular aspect, but an example thereof is as follows. That is, the second variable device includes a second control shaft provided so as to be rotatably controlled, and a control cam provided on the second control shaft so as to protrude therefrom. The control cam pushes the predetermined joint with the rotation of the second control shaft to shift the position of the predetermined joint during the base-circle time.

The cam may be a commonly used cam having only a main nose, but preferably may be structured as below for more effectively implementing the present invention. That is, the cam may include the main nose and a sub-nose. The sub-nose opens and closes the valve again after the main nose opens and closes the valve. The opening and closing of the valve by the sub-nose can be disabled by changing the lift curve by using the first variable device or the second variable device. In such an aspect, the maximum lift amount refers to a maximum lift amount caused by the main nose and the operation angle refers to an operation angle caused by the main nose.

Embodiment 1

Now, embodiments of the present invention will be described. Note that the present invention is not limited to those embodiments, and can be implemented by freely changing the structure or the form of each part of those embodiments without departing from the spirit of the present invention.

A variable valve mechanism 1 of Embodiment 1 shown in FIGS. 1 to 7B is a mechanism that opens and closes an inlet or exhaust valve 6, provided in an internal combustion engine and having a valve spring (not shown), by periodically pushing the valve 6. The variable valve mechanism 1 includes a cam 10, a transmission mechanism 20, a first variable device 50, and a second variable device 60.

[Cam 10]

Figure 2:
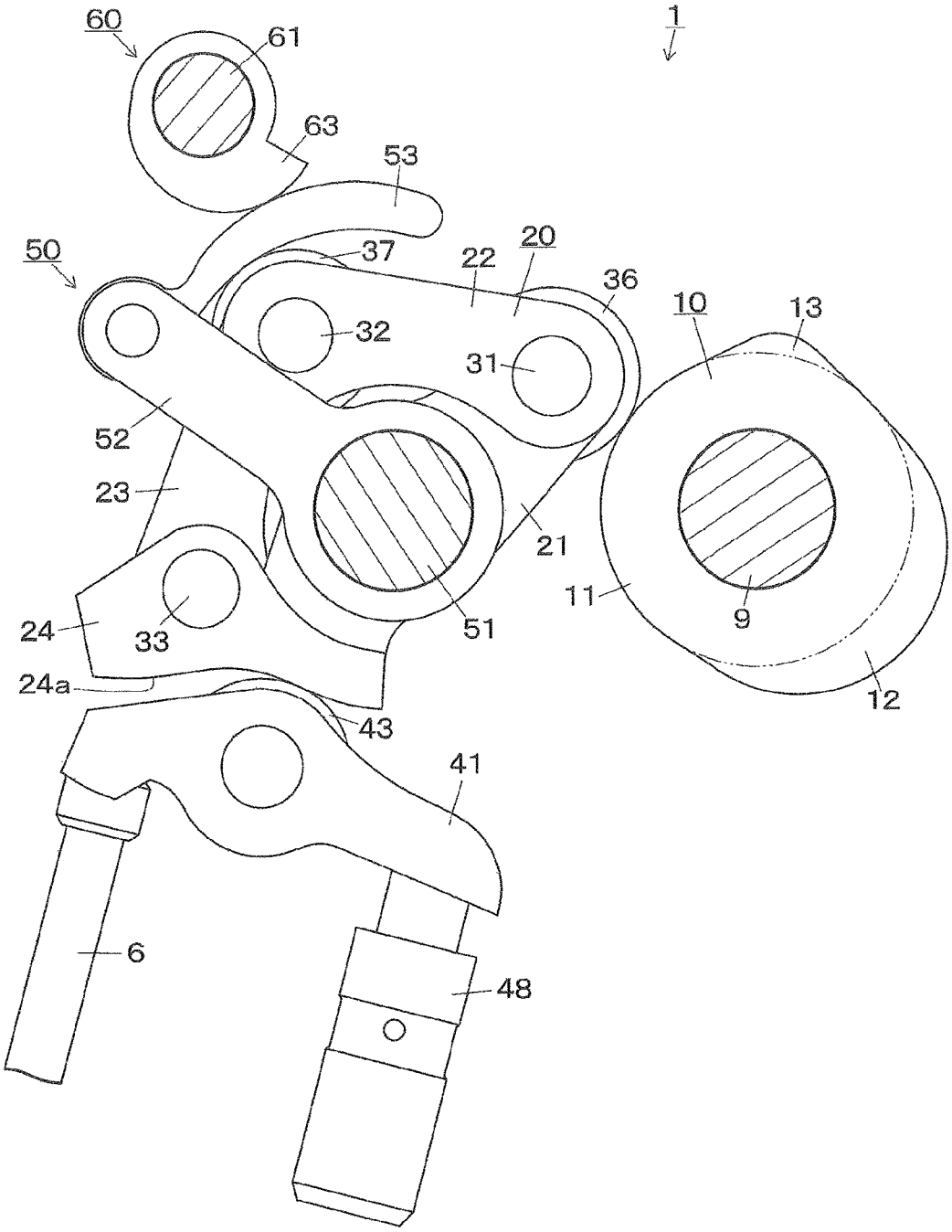
FIG. 2 is a side view showing the variable valve mechanism.

As shown in FIG. 1 etc., the cam 10 is provided on a cam shaft 9 so as to protrude therefrom and rotates with the cam shaft 9. The cam shaft 9 makes one full rotation for every two full rotation (720 degrees rotation) of the internal combustion engine. As shown in FIG. 2 etc., the cam 10 includes abase circle 11 having a circular cross section, and a main nose 12 and a sub-nose 13 both protruding from the base circle 11.

Figure 4B:
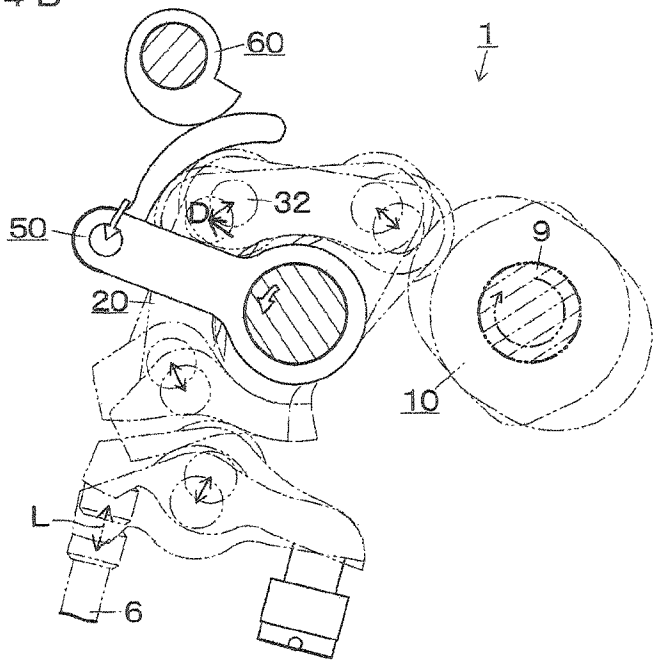
FIG. 4B is a side view of the variable valve mechanism showing a state where the valve is actually driven in the state of FIG. 3B.

The sub-nose 13 is a nose used to open the valve 6 twice (that is, open and close the valve 6 again after the main nose 12 opens and closes the valve 6) for the purpose of exhaust gas recirculation (EGR) or the like. As shown in FIG. 4C etc., the sub-nose 13 drives the valve 6 with a local-maximum lift amount Ls smaller than a maximum lift amount L of the main nose 12, and with an operation angle θs smaller than an operation angle θ (i.e. rotation angle range of the internal combustion engine in which the valve 6 is opened) of the main nose 12. In the case where the EGR is not performed, the sub-nose 13 is not formed.

[Transmission Mechanism 20]

The transmission mechanism 20 is a mechanism that transmits the profile of the cam 10 to the valve 6 so as to drive the valve 6. As shown in FIG. 2 etc., the transmission mechanism 20 includes four links of first to fourth links 21 to 24 (four-joint linkage) and a rocker arm 41. The first to the fourth links 21 to 24 are sequentially coupled to one another via first to third joints 31 to 33.

The first link 21 is rotatably supported, at an end portion of the first link 21 remote from the second link 22, by a first control shaft 51 of the first variable device 50 so as to swing. The first joint 31 that serves as a joint between the first link 21 and the second link 22 is provided with a roller-like cam follower 36, which contacts the cam 10 and can rotate. When the cam follower 36 is pushed by the cam 10, the first link 21 swings about the first control shaft 51.

The second and the third links 22, 23 are links that transmit the swinging force of the first link 21 to the fourth link 24. The second joint 32 that serves as a joint between the second link 22 and the third link 23 is provided with a roller-like rotatable slider 37.

The fourth link 24 is rotatably supported, at an end portion of the fourth link 24 remote from the third link 23, by the first control shaft 51 so as to swing. The fourth link 24 is provided, in its bottom surface, with a driving surface 24*a* that drives the valve 6 via the rocker arm 41 when swinging.

The rocker arm 41 is swingably supported at its base end by a lash adjuster 48, and is provided with a roller 42 at a middle portion of the rocker arm 41 in the longitudinal direction thereof. The roller 42 contacts the driving surface 24*a* of the fourth link 24 and can rotate. When swinging, the rocker arm 41 drives the valve 6 at the leading end of the rocker arm 41.

The four links 21 to 24 (four-joint linkage) are provided with return springs (not shown) used to bias the links 21 to 24 toward a return direction that is opposite to a lift direction (in which the valve 6 is lifted).

[First Variable Device 50]

Figure 7A:
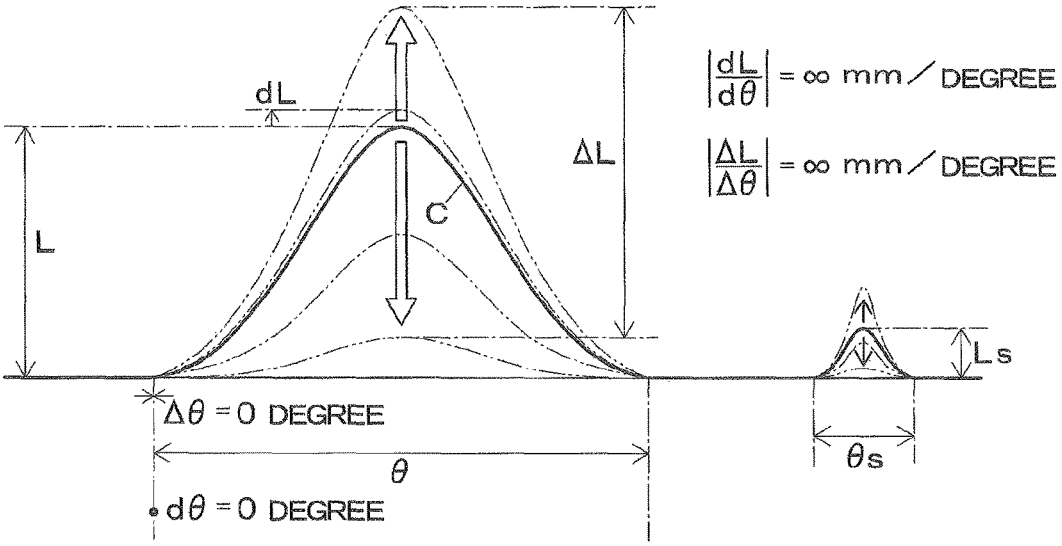
FIG. 7A is a diagram showing a lift curve of the variable valve mechanism, changed by the first variable device.

The first variable device 50 is a device that mainly changes the maximum lift amount L of a lift curve C. The lift curve C indicates a lift amount of the valve 6 corresponding to a rotation angle of the internal combustion engine. Note that the first variable device 50 does not change the maximum lift amount L to zero. As shown in FIGS. 3A and 3B, and FIGS. 4A and 4B, the first variable device 50 continuously shifts a reciprocating motion direction D of the second joint 32 when the valve is driven, without shifting an initial position of the second joint 32 (i.e. position during the base-circle time in which the base circle 11 of the cam 10 acts). The first variable device 50 thus continuously changes the maximum lift amount L without substantially changing the operation angle θ, as shown in FIG. 7A etc.

Accordingly, in the first variable device 50, a variable width Δθ of the operation angle θ is substantially zero. Therefore, an absolute value of a ratio ΔL/Δθ of a variable width ΔL of the maximum lift amount L to the variable width Δθ of the operation angle θ is substantially ∞ mm/degree. Furthermore, in any condition where the lift curve C lies within its variable range, for a slight change caused by the first variable device 50, an absolute value of a ratio dL/dθ of a maximum lift amount variation dL to an operation angle variation dθ is substantially ∞ mm/degree.

The first variable device 50 is configured as below. That is, as shown in FIG. 2 etc., the first variable device 50 includes the first control shaft 51, a rotary lever 52, and a guide member 53. The first control shaft 51 is provided so as to be rotatably controlled by a first actuator (not shown). The rotary lever 52 extends from the first control shaft 51 in a radial direction of the first control shaft 51 and rotates with the first control shaft 51. The guide member 53 is rotatably attached, at its base end, to the leading end of the rotary lever 52. The slider 37 contacts the guide member 53. The guide member 53 is a member that guides the reciprocating motion direction D of the second joint 32.

Figure 3B:
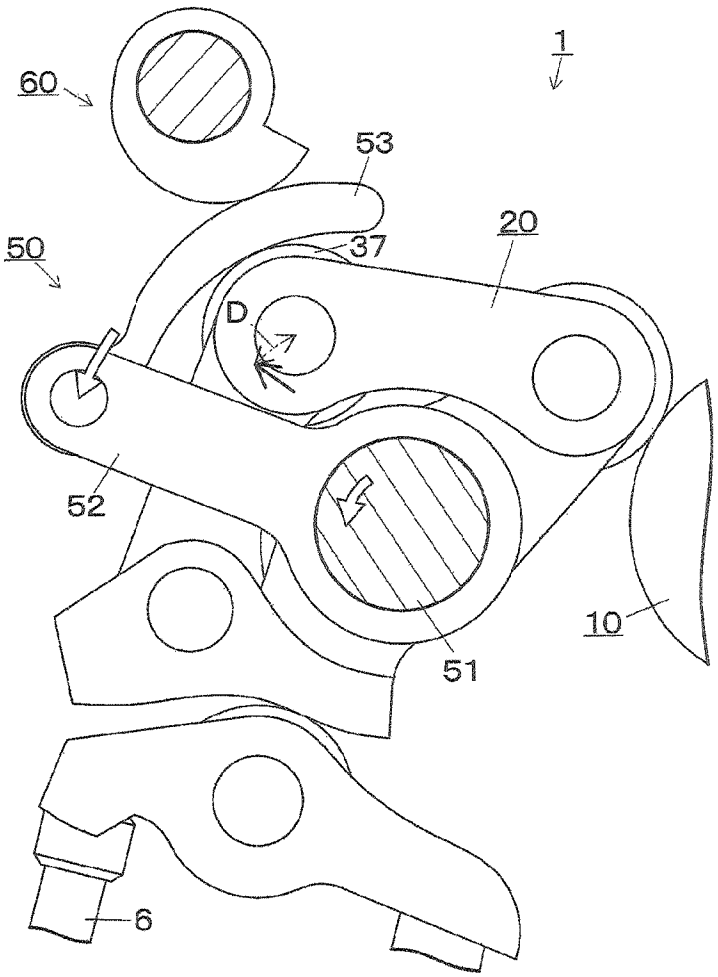
FIG. 3B is a side view of the variable valve mechanism in a state where the maximum lift amount is decreased by the first variable device.
Figure 3A:
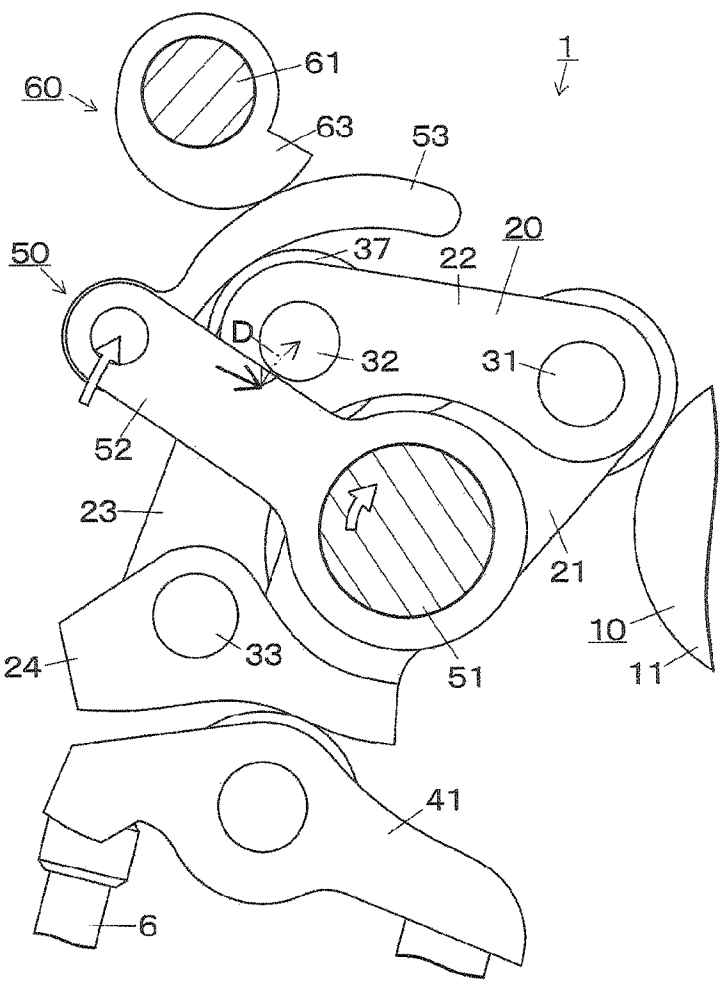
FIG. 3A is a side view of the variable valve mechanism in a state where a maximum lift amount is increased by a first variable device.
Figure 4A:
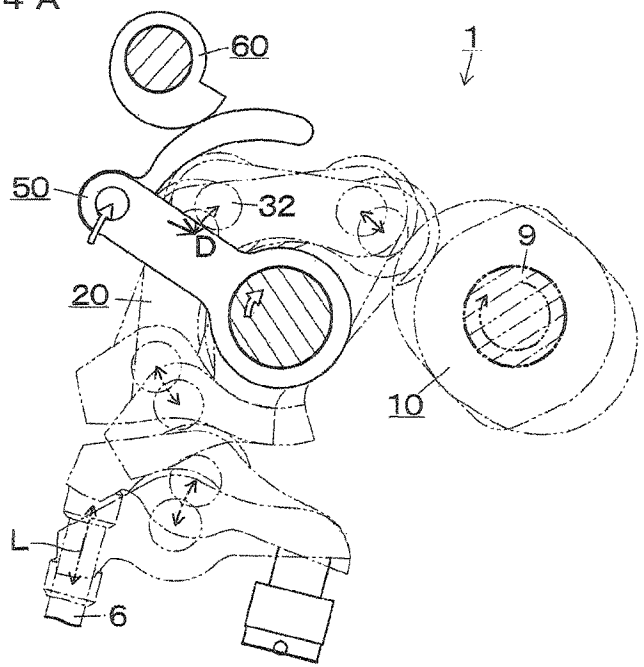
FIG. 4A is a side view of the variable valve mechanism showing a state where a valve is actually driven in the state of FIG. 3A.
Figure 4D:
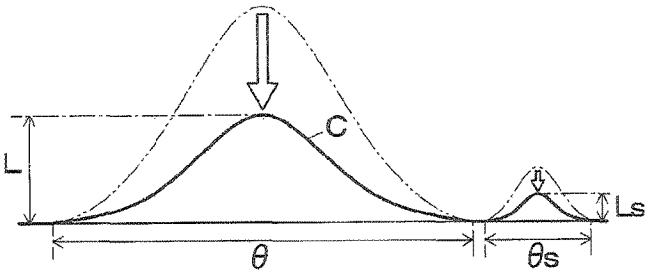
FIG. 4D is a diagram showing a lift curve obtained in FIG. 4B.
Figure 4C:
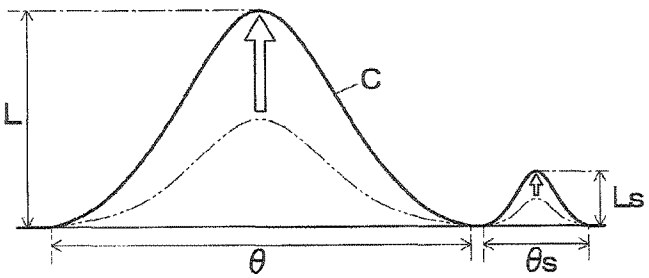
FIG. 4C is a diagram showing a lift curve obtained in FIG. 4A.

As shown in FIGS. 3A and 4A, as the first control shaft 51 is rotated in one direction, the guide member 53 is also displaced in the same direction. This causes a lift direction of the reciprocating motion direction D of the second joint 32 to be shifted in a radially inward direction of the first control shaft 51. As a result, the maximum lift amount L is increased without changing the operation angle θ, as shown in FIG. 4C.

As shown in FIGS. 3B and 4B, as the first control shaft 51 is rotated toward the other direction, the guide member 53 is also displaced in the same direction. This causes the lift direction of the reciprocating motion direction D of the second joint 32 to be shifted in a radially outward direction of the first control shaft 51. As a result, the maximum lift amount L is decreased without changing the operation angle θ, as shown in FIG. 4D.

[Second Variable Device 60]

Figure 5B:
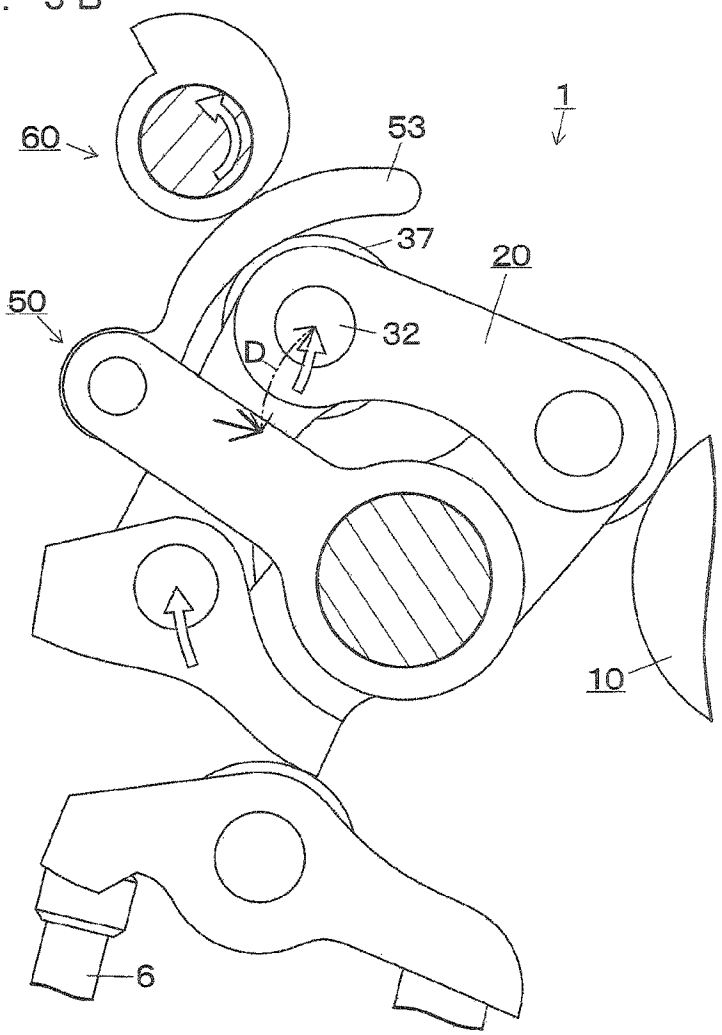
FIG. 5B is a side view of the variable valve mechanism in a state where the operation angle is decreased by the second variable device.

The second variable device 60 is a device that mainly changes the operation angle θ of the lift curve C. Note that the second variable device 60 does not change the operation angle θ to zero. As shown in FIGS. 5A and 5B, and FIGS. 6A and 6B, the second variable device 60 continuously shifts the initial position of the second joint 32 while continuously shifting the reciprocating motion direction D of the second joint 32. The second variable device 60 thus continuously changes the operation angle θ without substantially changing the maximum lift amount L, as shown in FIG. 7B.

Accordingly, in the second variable device 60, the variable width ΔL of the maximum lift amount L is substantially zero. Therefore, an absolute value of a ratio ΔL/Δθ of the variable width ΔL of the maximum lift amount L to the variable width Δθ of the operation angle θ is substantially 0 mm/degree. Furthermore, in any condition where the lift curve C lies within its variable range, for a slight change caused by the second variable device 60, an absolute value of a ratio dL/dθ of the maximum lift amount variation dL to the operation angle variation dθ is substantially 0 mm/degree.

The second variable device 60 is configured as below. That is, as shown in FIG. 2 etc., the second variable device 60 includes a second control shaft 61 and a control cam 63. The second control shaft 61 is provided to be rotatably controlled by a second actuator (not shown). The control cam 63 is provided on the second control shaft 61 so as to protrude therefrom, and rotates with the second control shaft 61.

Figure 5A:
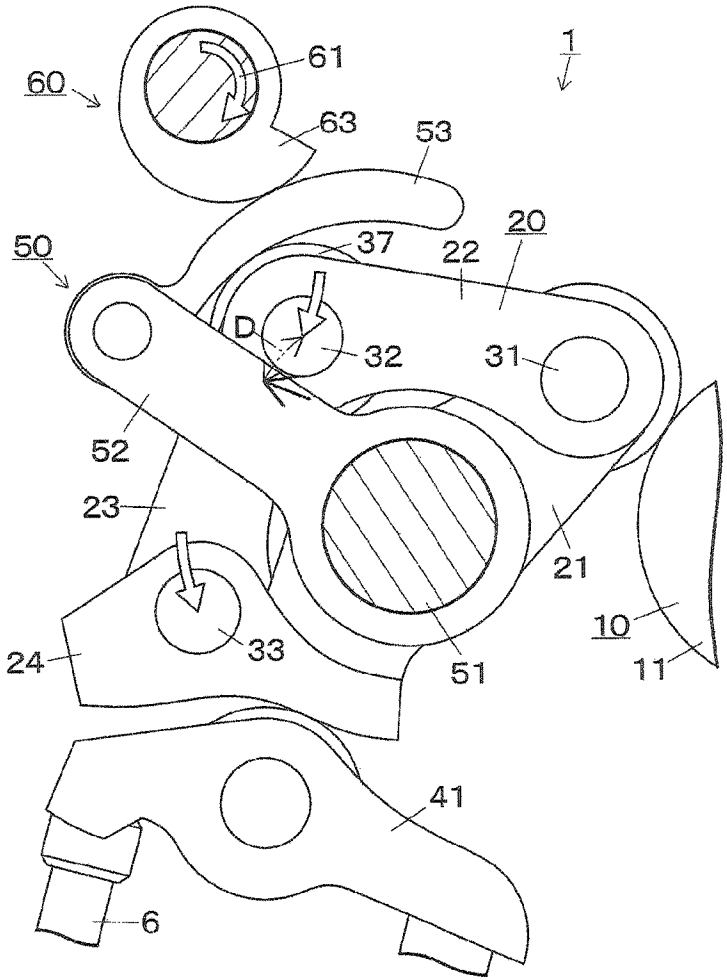
FIG. 5A is a side view of the variable valve mechanism in a state where an operation angle is increased by a second variable device.
Figure 6B:
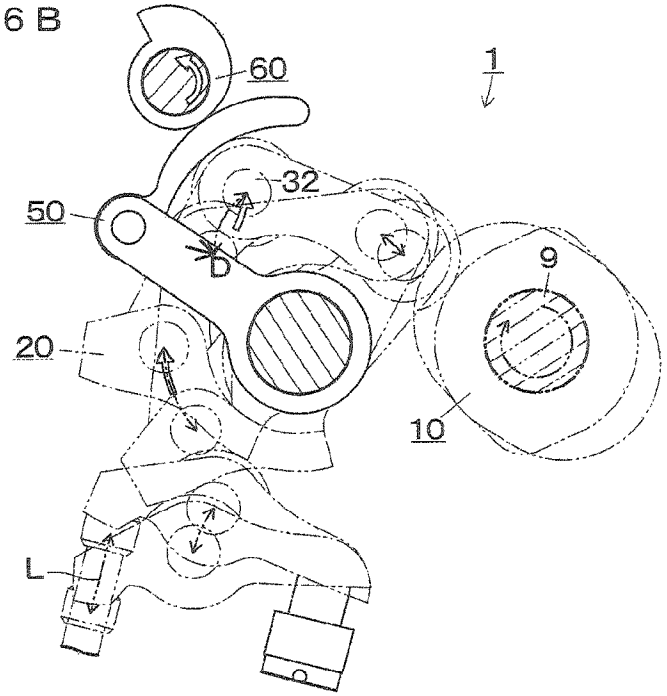
FIG. 6B is a side view of the variable valve mechanism showing a state where the valve is actually driven in the state of FIG. 5B.
Figure 6A:
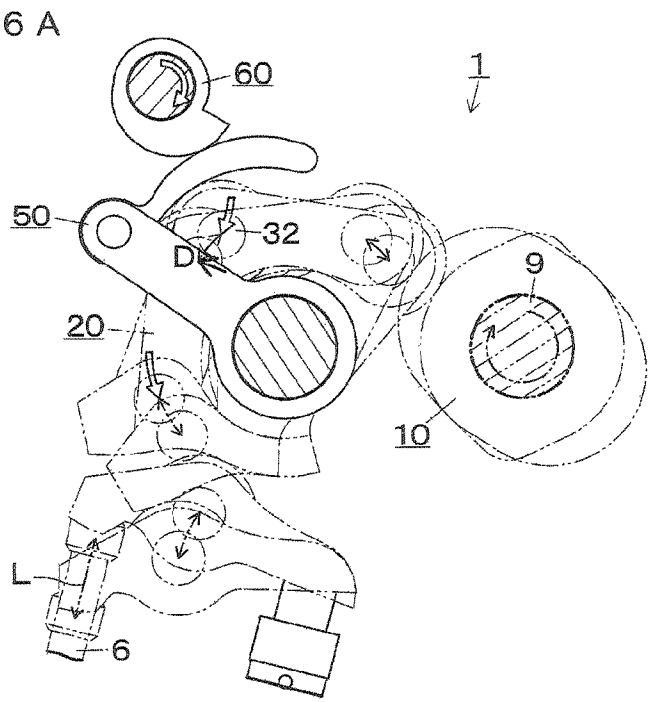
FIG. 6A is a side view of the variable valve mechanism showing a state where the valve is actually driven in the state of FIG. 5A.
Figure 6D:
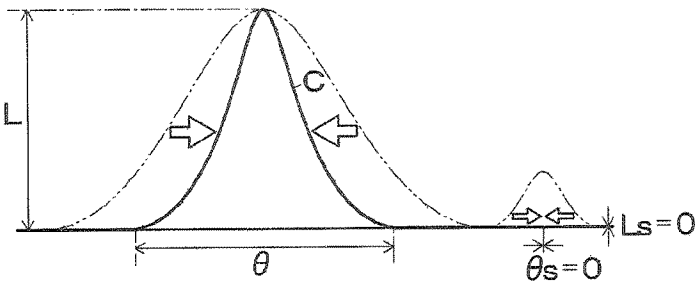
FIG. 6D is a diagram showing a lift curve obtained in FIG. 6B.
Figure 6C:
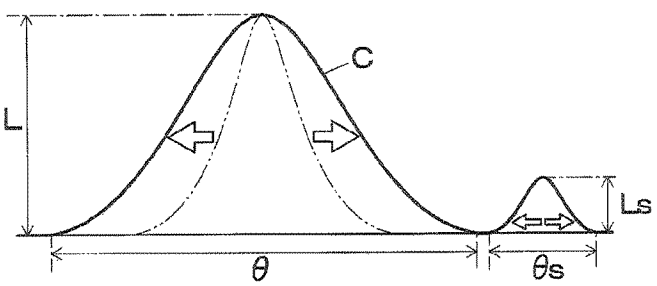
FIG. 6C is a diagram showing a lift curve obtained in FIG. 6A.
Figure 7B:
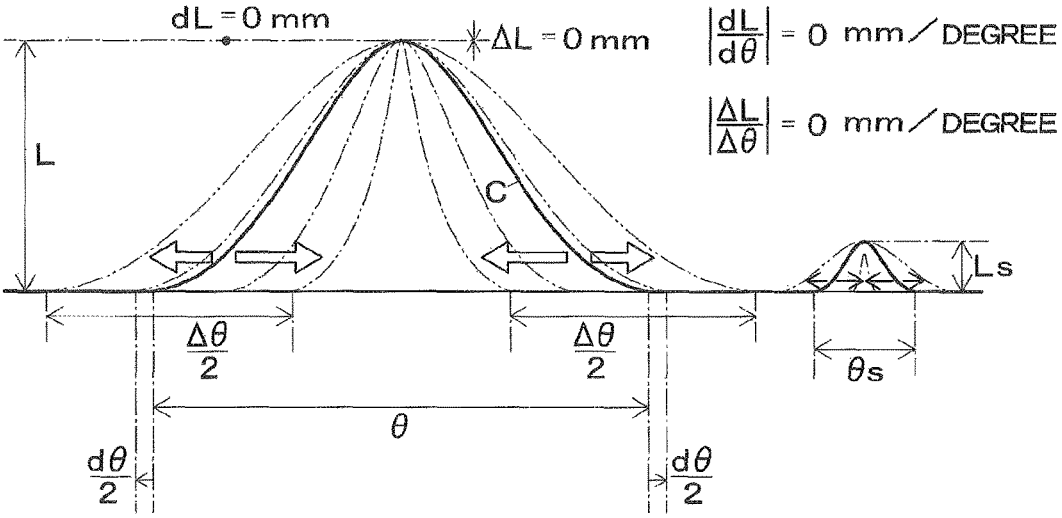
FIG. 7B is a diagram showing a lift curve of the variable valve mechanism, changed by the second variable device.

As shown in FIGS. 5A and 6A, as the second control shaft 61 is rotated in one direction, the control cam 63 pushes the second joint 32, via the guide member 53 and the slider 37, in a radially outward direction of the second control shaft 61. This causes the initial position of the second joint 32 to be shifted in the lift direction. As a result, the operation angle θ is increased as shown in FIG. 6C. At this time, the maximum lift amount L is not increased. This is because the initial position of the second joint 32 is shifted while the lift direction of the reciprocating motion direction D of the second joint 32 is shifted in the radially outward direction of the first control shaft 51, so that the increase in the maximum lift amount L is canceled.

As shown in FIGS. 5B and 6B, as the second control shaft 61 is rotated in the other direction to retract the nose of the control cam 63, the second joint 32 is shifted in an radially inward direction of the second control shaft 61 by spring force of a return spring (not shown). This causes the initial position of the second joint 32 to be shifted in a return direction. As a result, the operation angle θ is decreased as shown in FIG. 6D. At this time, the maximum lift amount L is not decreased. This is because the initial position of the second joint 32 is shifted while the lift direction of the reciprocating motion direction D of the second joint 32 is shifted in the radially inward direction of the first control shaft 51, so that the decrease in the maximum lift amount L is canceled.

[Effect]

According to Embodiment 1, the following effects can be produced. That is, since the maximum lift amount L can be continuously changed without changing the operation angle θ by the first variable device 50, and since the operation angle θ can be continuously changed without changing the maximum lift amount L by the second variable device 60, the maximum lift amount L and the operation angle θ can be freely changed.

Moreover, since the operation angles θ and θs can be decreased by the second variable device 60 to disable the opening and closing of the valve 6 performed by the sub-nose 13, and since the maximum lift amount L caused by the main nose 12 can be increased by the first variable device 50, the valve 6 can be opened one time instead of two times, with a necessary valve-driving amount kept by the main nose 12.

Embodiment 2

Figure 8A:
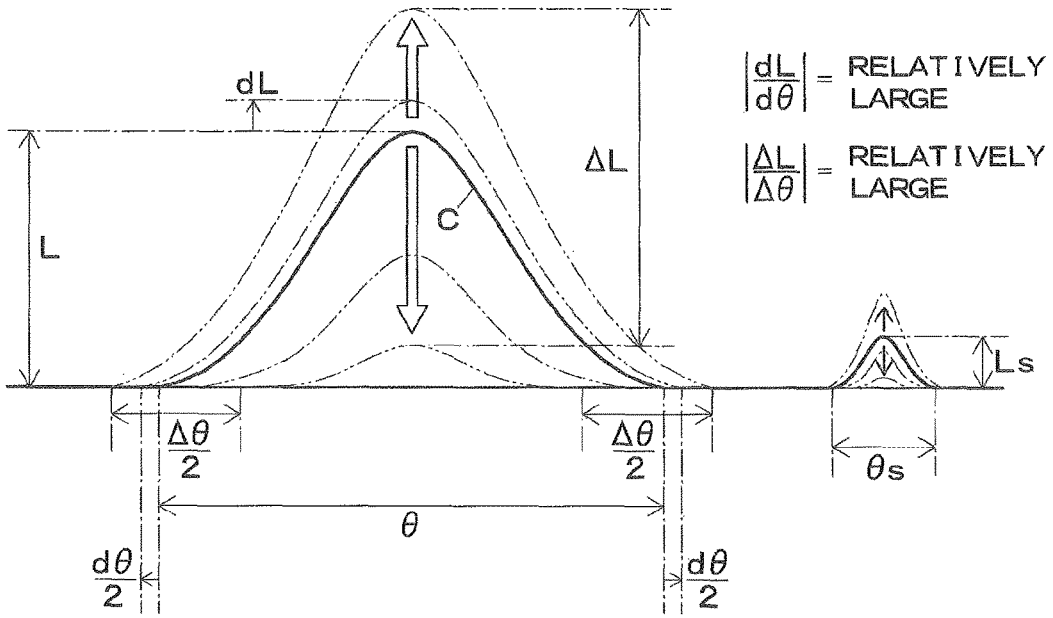
FIG. 8A is a diagram showing a lift curve of a variable valve mechanism of Embodiment 2, changed by the first variable device.
Figure 8B:
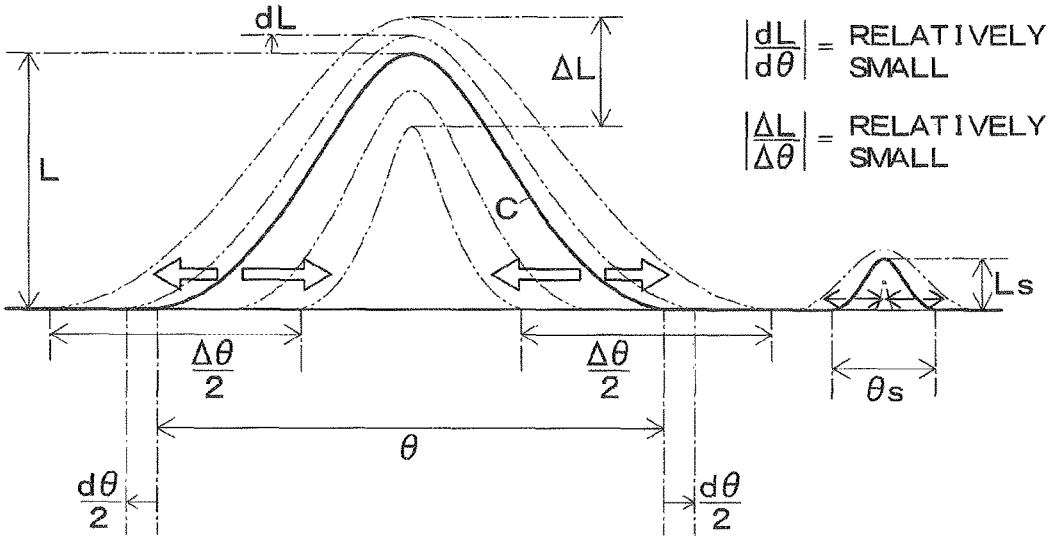
FIG. 8B is a diagram showing a lift curve of the variable valve mechanism of Embodiment 2, changed by the second variable device.
Figure 9A:
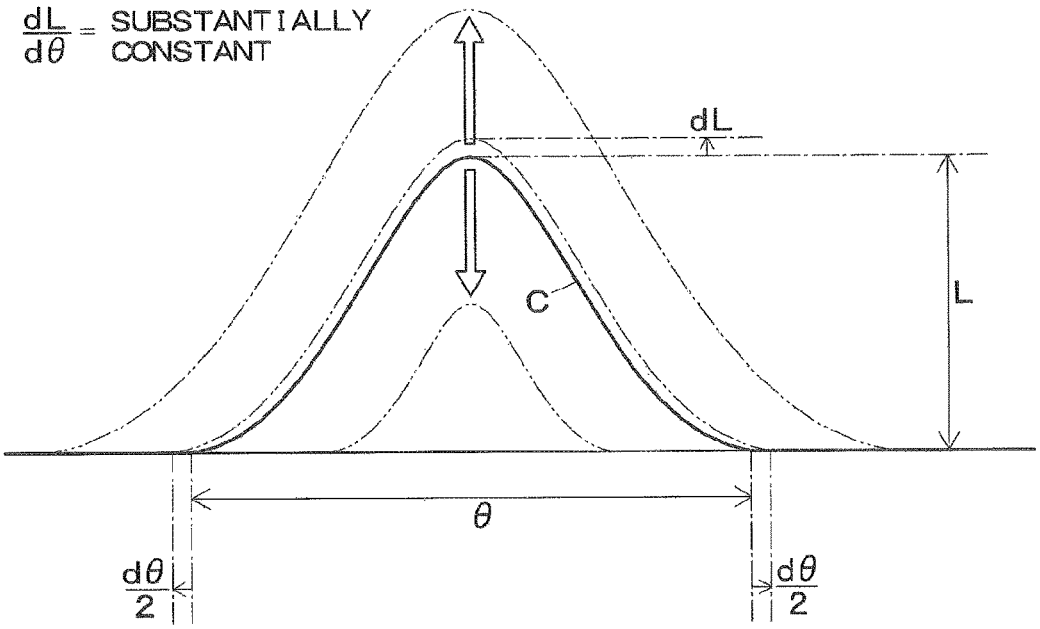
FIG. 9A PRIOR ART
FIG. 9A is a diagram showing a lift curve of a variable valve mechanism of Patent Documents 1, 3 and 4.
Figure 9B:
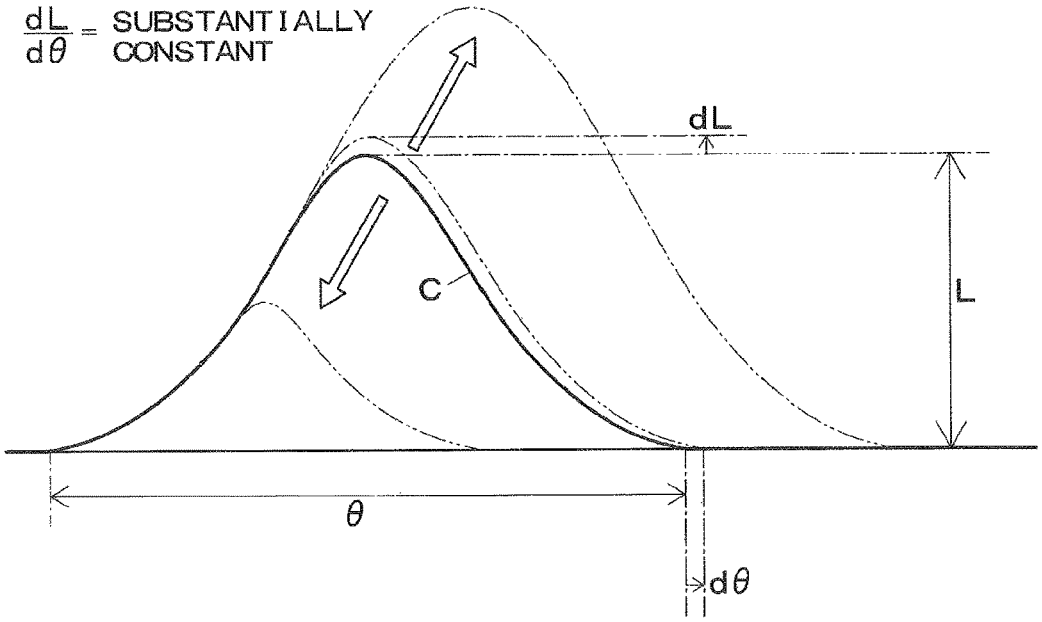
FIG. 9B PRIOR ART
FIG. 9B is a diagram showing a lift curve of a variable valve mechanism of Patent Document 2.

Embodiment 2 shown in FIG. 8 is different from. Embodiment 1 in that each part of the first variable device and each part of the second variable device of Embodiment 2 have different sizes from those of Embodiment 1. Therefore, as shown in FIG. 8A, the first variable device changes the maximum lift amount L and also slightly changes the operation angle θ. In addition, as shown in FIG. 8B, the second variable device changes the operation angle θ and also slightly changes the maximum lift amount L.

To be specific, the variable width ΔL of the maximum lift amount L for the first variable device is larger than that for the second variable device; the variable width Δθ of the operation angle θ for the first variable device is smaller than that for the second variable device. Accordingly, the absolute value of the ratio ΔL/Δθ of the variable width ΔL of the maximum lift amount L to the variable width Δθ of the operation angle θ for the first variable device is larger than that for the second variable device. Furthermore, in any condition where the lift curve C lies within its variable range, an absolute value of the ratio dL/dθ of the maximum lift amount variation dL to the operation angle variation dθ for a slight change from the above any condition caused by the first variable device is larger than that for a slight change from the condition caused by the second variable device.

Embodiment 2 as well, the maximum lift amount L and the operation angle θ can be freely changed by controlling the maximum lift amount L and the operation angle θ by using the first variable device and the second variable device.

REFERENCE SIGNS LIST

1 Variable valve mechanism
6 Valve
9 Cam shaft
10 Cam
11 Base circle
12 Main nose
13 Sub-nose
20 Transmission mechanism
21 First link
22 Second link
23 Third link
24 Fourth link
32 Second joint (predetermined joint)
50 First variable device
51 First control shaft
52 Rotary lever
53 Guide member
60 Second variable device
61 Second control shaft
63 Control cam
C Lift curve
L Maximum lift amount
dL Maximum lift amount variation
ΔL Variable width of maximum lift amount
θ Operation angle
dθ Operation angle variation
Δθ Variable width of operation angle
D Reciprocating motion direction of second joint

The invention claimed is:

1. A variable valve mechanism of an internal combustion engine, comprising:

a cam that rotates with rotation of the internal combustion engine;

a transmission mechanism that transmits a profile of the cam to valve to drive the valve;

a first variable device that controls the transmission mechanism to continuously change at least a maximum lift amount of a lift curve indicating a lift amount of the valve that corresponds to a rotation angle of the internal combustion engine; and a second variable device that controls the transmission mechanism to continuously change at least an operation angle of the lift curve, wherein, when the lift curve lies in any condition within a predetermined range that covers all or art of a variable range of the lift curve, an absolute value of a ratio of a maximum lift amount variation to an operation angle variation for a slight change from the condition caused by the first variable device is larger than that for a slight change from the condition caused by the second variable device, wherein the transmission mechanism includes four links coupled to one another via joints, the first variable device shifts at least a reciprocating motion direction of a predetermined joint when the valve is driven, and the second variable device shifts at least a position of the predetermined joint during a base-circle time in which a base circle of the cam acts.

2. The variable valve mechanism according to claim 1, wherein the first variable device includes: a first control shaft provided so as to be rotatably controlled; a rotary lever that extends from the first control shaft in a radial direction of the first control shaft and rotates with the first control shaft; and a guide member rotatably attached to a leading end of the rotary lever so as to guide the reciprocating motion direction of the predetermined joint.

3. The variable valve mechanism according to claim 2, wherein two of the four links are rotatably supported on the first control shaft so as to swing.

4. The variable valve mechanism according to claim 1, wherein the second variable device includes: a second control shaft provided so as to be rotatably controlled; and a control cam provided on the second control shaft so as to protrude therefrom, and the control cam pushes the predetermined joint with rotation of the second control shaft to shift the position of the predetermined joint during the base-circle time.

5. The variable valve mechanism according to claim 1, wherein the absolute value of the ratio for the slight change caused by the first variable device is substantially co mm/degree, and the absolute value of the ratio for the slight change caused by the second variable device is substantially 0 mm/degree.

6. A variable valve mechanism of an internal combustion engine, comprising:

a cam that rotates with rotation of the internal combustion engine;

a transmission mechanism that transmits a profile of the cam to a valve to drive the valve;

a first variable device that controls the transmission mechanism to continuously change at least a maximum lift amount of a lift curve indicating a lift amount of the valve that corresponds to a rotation angle of the internal combustion engine; and a second variable device that controls the transmission mechanism to continuously change at least an operation angle of the lift curve, wherein, when the lift curve lies in any condition within a predetermined range that covers all or part of a variable ran a of the lift curve, an absolute value of a ratio of a maximum lift amount variation to an operation al e variation for a slight change from the condition caused by the first variable device is larger than that for a slight change from the condition caused by the second variable device, wherein the cam includes a main nose and a sub-nose that opens and closes the valve again after the main nose opens and closes the valve, and the opening and closing of the valve performed by the sub-nose can be disabled by changing the lift curve by using the first variable device or the second variable device.

7. A variable valve mechanism of an internal combustion engine, comprising:

a cam that rotates with rotation of the internal combustion engine;

a transmission mechanism that transmits a profile of the cam to a valve to drive the valve;

a first variable device that controls the transmission mechanism to continuously change at least a maximum lift amount of a lift curve indicating a lift amount of the valve that corresponds to a rotation angle of the internal combustion engine; and a second variable device that controls the transmission mechanism to continuously change at least an operation angle of the lift curve, wherein a variable width of the maximum lift amount for the first variable device is larger than that for the second variable device, and a variable width of the operation angle for the first variable device is smaller than that for the second variable device, wherein the transmission mechanism includes four links coupled to one another via joints, the first variable device shifts at least a reciprocating motion direction of a predetermined joint when the valve is driven, and the second variable device shifts at least a position of the predetermined joint during a base-circle time in which a base circle of the cam acts.

8. The variable valve mechanism according to claim 7, wherein the first variable device includes: a first control shaft provided so as to be rotatably controlled; a rotary lever that extends from the first control shaft in a radial direction of the first control shaft and rotates with the first control shaft; and a guide member rotatably attached to a leading end of the rotary lever so as to guide the reciprocating motion direction of the predetermined joint.

9. The variable valve mechanism according to claim 7, wherein the second variable device includes: a second control shaft provided so as to be rotatably controlled; and a control cam provided on the second control shaft so as to protrude therefrom, and the control cam pushes the predetermined joint with rotation of the second control shaft to shift the position of the predetermined joint during the base-circle time.

10. The variable valve mechanism according to claim 7, wherein the variable width of the maximum lift amount for the first variable device is equal to or larger than ten times that for the second variable device, and the variable width of the operation angle for the first variable device is equal to or smaller than one-tenth that for the second variable device.

11. The variable valve mechanism according to claim 10, wherein the variable width of the operation angle for the first variable device is substantially zero, and the variable width of the maximum lift amount for the second variable device is substantially zero.

12. A variable valve mechanism of an internal combustion engine comprising:

a cam that rotates with rotation of the internal combustion engine;

a transmission mechanism that transmits a profile of the cam to a valve to drive the valve;

a first variable device that controls the transmission mechanism to continuously change at least a maximum lift amount of a lift curve indicating a lift amount of the valve that corresponds to a rotation angel of the internal combustion engine; and a second variable device that controls the transmission mechanism to continuously change at least an operation angle of the lift curve, wherein an absolute value of a ratio of a variable width of the maximum lift amount to a variable width of the operation angle for the first variable device is larger than that for the second variable device, wherein the transmission mechanism includes four links coupled to one another via joints, the first variable device shifts at least a reciprocating motion direction of a predetermined joint when the valve is driven, and the second variable device shifts at least a position of the predetermined joint during a base-circle time in which a base circle of the cam acts.

13. The variable valve mechanism according to claim 12, wherein the first variable device includes: a first control shaft provided so as to be rotatably controlled; a rotary lever that extends from the first control shaft in a radial direction of the first control shaft and rotates with the first control shaft; and a guide member rotatably attached to a leading end of the rotary lever so as to guide the reciprocating motion direction of the predetermined joint.

14. The variable valve mechanism according to claim 12, wherein the second variable device includes: a second control shaft provided so as to be rotatably controlled; and a control cam provided on the second control shaft so as to protrude therefrom, and the control cam pushes the predetermined joint with rotation of the second control shaft to shift the position of the predetermined joint during the base-circle time.

15. The variable valve mechanism according to claim 12, wherein the absolute value of the ratio for the first variable device is equal to or larger than ten times that for the second variable device.

16. The variable valve mechanism according to claim 15, wherein the absolute value of the ratio for the first variable device is substantially ∞ mm/degree; and the absolute value of the ratio for the second variable device is substantially 0 mm/degree.

* * * * *